US008490553B1

(12) United States Patent
English et al.

(10) Patent No.: US 8,490,553 B1
(45) Date of Patent: Jul. 23, 2013

(54) CAKE STACKER SYSTEM

(75) Inventors: Richard P. English, Milton, FL (US); Stephanie R. English, Milton, FL (US)

(73) Assignees: Joel D. Ronan, Jensen Beach, FL (US); Jana L. Ronan, Jensen Beach, FL (US)

( * ) Notice: Subject to any disclaimer, the term of this patent is extended or adjusted under 35 U.S.C. 154(b) by 37 days.

(21) Appl. No.: 12/661,461

(22) Filed: Mar. 17, 2010

(51) Int. Cl.
*A47B 57/00* (2006.01)

(52) U.S. Cl.
USPC ..... 108/101; 248/159

(58) Field of Classification Search
USPC ..... 426/383; 248/425, 349.1, 419, 159, 248/415, 176.1, 519, 521–523; 108/139, 108/141, 142, 90, 101; 211/187, 133.1, 144, 211/85.4, 131; 312/408, 305, 125, 135
See application file for complete search history.

(56) References Cited

U.S. PATENT DOCUMENTS

| | | | | | |
|---|---|---|---|---|---|
| 197,931 | A | * | 12/1877 | Haight | 108/94 |
| 1,360,856 | A | * | 11/1920 | Zander | 108/20 |
| 1,401,057 | A | * | 12/1921 | Elliott | 108/101 |
| 2,488,641 | A | * | 11/1949 | Seawright | 108/94 |
| 2,902,174 | A | * | 9/1959 | Audsley | 108/101 |
| 3,169,496 | A | * | 2/1965 | Muggli et al. | 108/94 |
| 3,179,070 | A | * | 4/1965 | Beller | 108/103 |
| 3,543,699 | A | * | 12/1970 | Leikarts | 108/59 |
| 3,690,610 | A | * | 9/1972 | Peirce et al. | 248/159 |
| 3,814,032 | A | * | 6/1974 | McMains | 108/101 |
| 4,539,914 | A | * | 9/1985 | Lebecque | 108/94 |
| 5,165,637 | A | * | 11/1992 | Polley et al. | 248/188.4 |
| 5,343,815 | A | * | 9/1994 | Dickinson | 108/56.3 |
| D357,160 | S | * | 4/1995 | Fritze | D6/474 |
| 5,617,798 | A | * | 4/1997 | Lytell | 108/147.19 |
| D413,046 | S | * | 8/1999 | Fritze | D7/610 |
| 6,367,759 | B1 | | 4/2002 | Simon | |
| 6,688,239 | B1 | * | 2/2004 | Pettini et al. | 108/50.11 |
| 7,975,643 | B1 | * | 7/2011 | Johnson | 118/14 |
| 2010/0330240 | A1 | * | 12/2010 | Jeffery | 426/383 |

* cited by examiner

*Primary Examiner* — Nkeisha Smith

(57) ABSTRACT

A base plate has a center and a periphery. Lower and upper cake support plates have centers and peripheries and central apertures. A center post extends through the center apertures and is coupled to the base plate and the upper cake support plate. A plurality of dowels are coupled to the lower cake support plate and the upper cake support plate and extend downwardly therefrom.

1 Claim, 4 Drawing Sheets

FIG 1
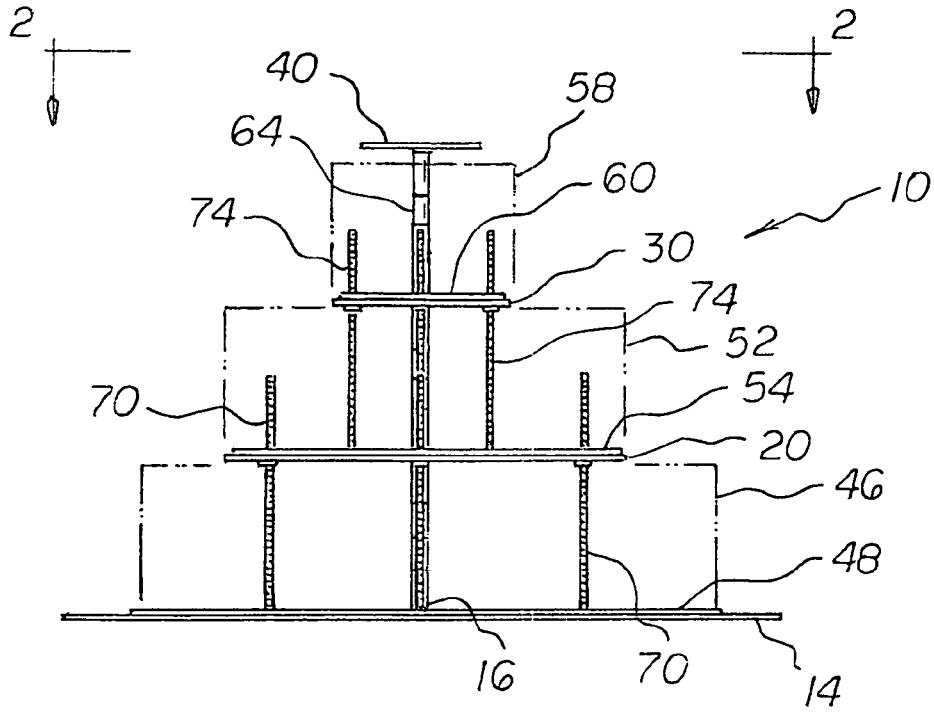
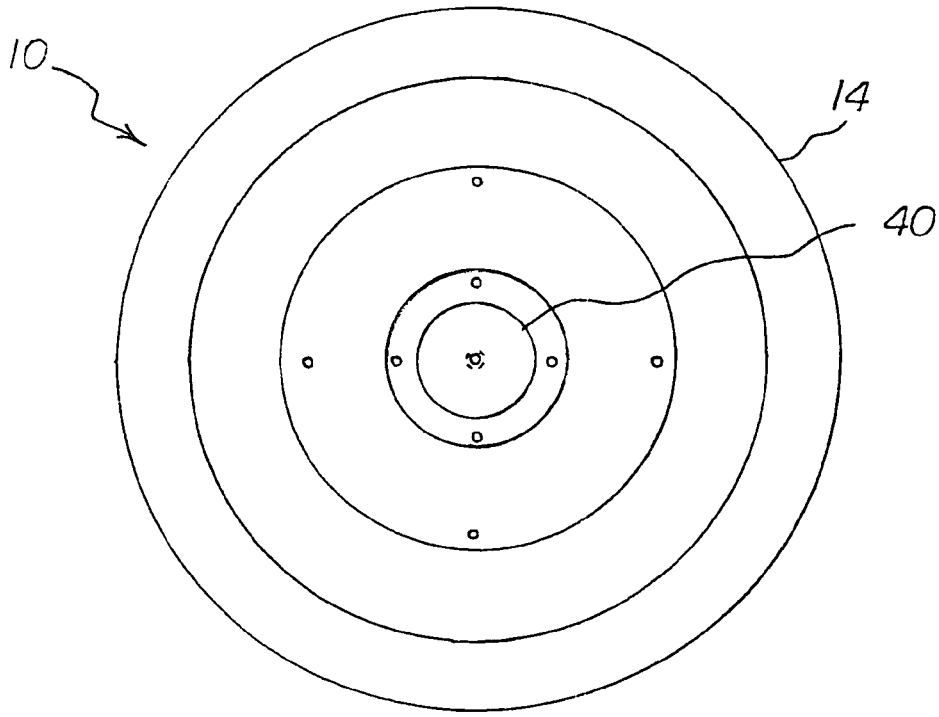
FIG 2

FIG 4
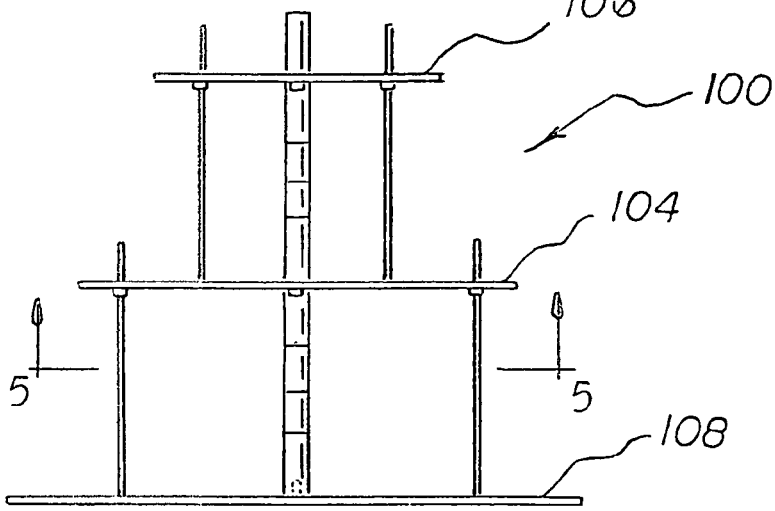
FIG 5
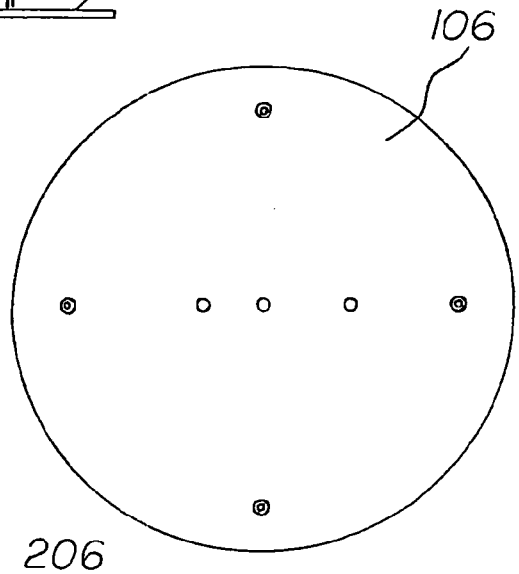
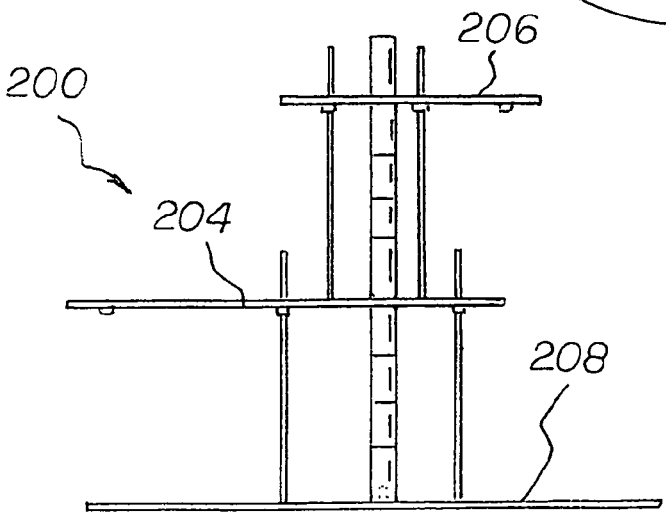
FIG 6

CAKE STACKER SYSTEM

BACKGROUND OF THE INVENTION

1. Field of the Invention

The present invention relates to a cake stacker system and more particularly pertains to supporting and displaying a multi-layer cake in a safe, secure, convenient and economical manner.

2. Description of the Prior Art

The use of cake stacking systems of known designs and configurations is known in the prior art. More specifically, cake stacking systems of known designs and configurations previously devised and utilized for the purpose of supporting and displaying multi-layer cakes are known to consist basically of familiar, expected, and obvious structural configurations, notwithstanding the myriad of designs encompassed by the crowded prior art which has been developed for the fulfillment of countless objectives and requirements.

By way of example, U.S. Pat. No. 5,165,637 issued Nov. 24, 1992 to Polley relates to a Cake Jack. U.S. Pat. No. D413,046 issued Aug. 24, 1999 to Fritze relates to a Set of Removable Cake Plates for an Asymmetrical Cake Stand. Lastly, U.S. Pat. No. 6,367,759 issued Apr. 9, 2002 to Simon relates to a Gripping Means and Apparatus for Attaching a Rotational Cake Decorating Apparatus.

While these devices fulfill their respective, particular objectives and requirements, the aforementioned patents do not describe a cake stacker system that allows supporting and displaying a multi-layer cake in a safe, secure, convenient and economical manner.

In this respect, the cake stacker system according to the present invention substantially departs from the conventional concepts and designs of the prior art, and in doing so provides an apparatus primarily developed for the purpose of supporting and displaying a multi-layer cake in a safe, secure, convenient and economical manner.

Therefore, it can be appreciated that there exists a continuing need for a new and improved cake stacker system which can be used for supporting and displaying a multi-layer cake in a safe, secure, convenient and economical manner. In this regard, the present invention substantially fulfills this need.

SUMMARY OF THE INVENTION

In view of the foregoing disadvantages inherent in the known types of cake stacking systems of known designs and configurations now present in the prior art, the present invention provides an improved cake stacker system. As such, the general purpose of the present invention, which will be described subsequently in greater detail, is to provide a new and improved cake stacker system and method which has all the advantages of the prior art and none of the disadvantages.

To attain this, the present invention essentially comprises a base plate in a circular configuration with a center and a periphery and a first diameter. A threaded stud extends upwardly from the center of the base plate.

Next provided is a lower cake support plate in a circular configuration with a center and a periphery and a second diameter less than the first diameter. A central aperture extends through the center of the lower cake support plate. A plurality of lower peripheral apertures extend through the lower cake support plate adjacent to the periphery thereof. A plurality of primary nuts are provided. The nuts are secured to the lower cake support plate. Each primary nuts extends downwardly from one of the lower peripheral apertures.

Next provided is an upper cake support plate in a circular configuration with a center and a periphery and a third diameter less than the second diameter. A central aperture extending through the center of the upper cake support plate. A plurality of upper peripheral apertures extend through the upper cake support plate adjacent to the periphery thereof. A plurality of secondary nuts are provided. The secondary nuts are secured to the upper cake support plate. Each secondary nut extends downwardly from one of the upper peripheral apertures.

A top cap plate is next provided. The top cap plate is in a circular configuration with a center and a periphery and a fourth diameter less than the third diameter. A central nut extends downwardly from the center of the top cap plate.

Next, a lower cake is provided. The lower cake is on a lower cake board and is positioned between the base plate and the lower cake support plate. The lower cake has a diameter between the first and second diameters.

Next, an intermediate cake is provided. The intermediate cake is on an intermediate cake board and is positioned between the lower and upper cake support plates. The intermediate cake has a diameter between the second and third diameters.

Next, an upper cake is provided. The upper cake is on an upper cake board and is positioned between the upper support plate and the top cap plate. The upper cake has a diameter between the third and fourth diameters.

A center post is next provided. The center post is formed of a plurality of threaded rods extending through the cakes and center apertures of the cake support plates. A plurality of threaded collars are threadedly received on the threaded rods and the studs in contact with the base plate and the cake support plates and the top cap plate. A plurality of unthreaded collars on the threaded rods between the threaded collars are provided. The unthreaded collars are of sizes to separate the cakes to heights corresponding to thicknesses of the cakes.

Next, a plurality of threaded lower dowels extending through the lower peripheral apertures and nuts of the lower cake support plate are provided. The lower dowels extend downwardly to a location adjacent to the base plate and extend upwardly a distance between 25 and 75 percent of the thickness of the lower cake.

Lastly, in the primary embodiment, a plurality of threaded upper dowels extending through the upper peripheral apertures and nuts of the upper cake support plate are provided. The upper dowels extend downwardly to a location adjacent to the lower cake support plate and extend upwardly a distance between 25 and 75 percent of the thickness of the upper cake.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved cake stacker system which has all of the advantages of the prior art cake stacking systems of known designs and configurations and none of the disadvantages.

It is another object of the present invention to provide a new and improved cake stacker system which may be easily and efficiently manufactured and marketed.

It is further object of the present invention to provide a new and improved cake stacker system which is of durable and reliable constructions.

An even further object of the present invention is to provide a new and improved cake stacker system which is susceptible of a low cost of manufacture with regard to both materials and labor, and which accordingly is then susceptible of low prices of sale to the consuming public, thereby making such cake stacker system economically available to the buying public.

Even still another object of the present invention is to provide a cake stacker system for supporting and displaying a multi-layer cake in a safe, secure, convenient and economical manner.

Lastly, it is an object of the present invention to provide a new and improved cake stacker system with a base plate having a center and a periphery, lower and upper cake support plates having centers and peripheries and central apertures, a center post extending through the center apertures and coupled to the base plate and the upper cake support plate, and a plurality of dowels coupled to the lower cake support plate and the upper cake support plate and extending downwardly therefrom.

These together with other objects of the invention, along with the various features of novelty which characterize the invention, are pointed out with particularity in the claims annexed to and forming a part of this disclosure.

For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a side elevational view of a cake stacker system constructed in accordance with the principles of the present invention.

FIG. 2 is a plan view of the system taken along line 2-2 of FIG. 1.

FIG. 4 is a front elevational view constructed in accordance with an alternate embodiment of the invention.

FIG. 5 is a cross sectional view of the system taken along line 5-5 of FIG. 4.

FIGS. 6 through 10 are various views constructed in accordance with additional alternate embodiments of the invention.

The same reference numerals refer to the same parts throughout the various Figures.

DESCRIPTION OF THE PREFERRED EMBODIMENT

Figure 3:
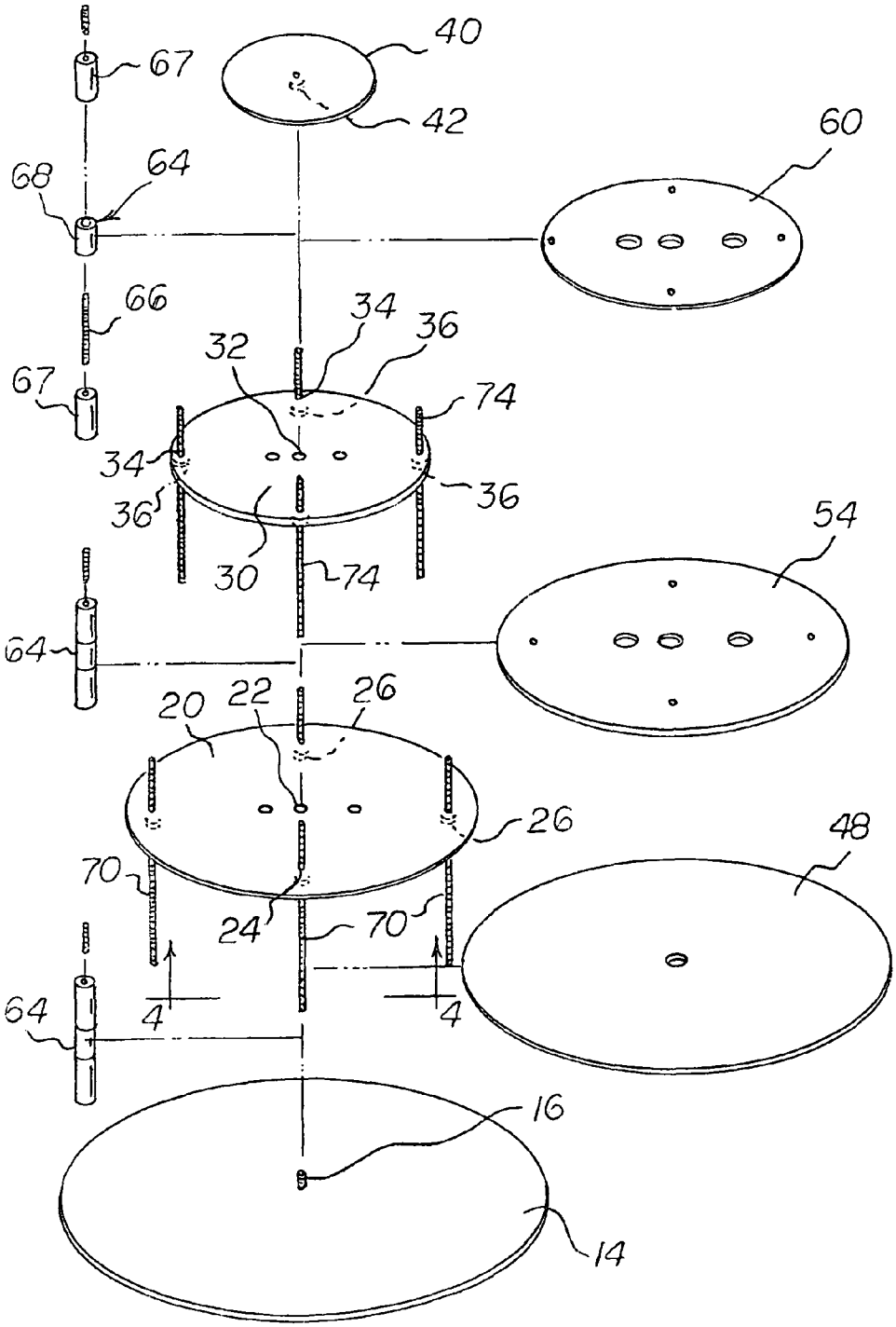
FIG. 3 is an exploded perspective view of the system of the prior Figures.

With reference now to the drawings, and in particular to FIG. 1 thereof, the preferred embodiment of the new and improved cake stacker system embodying the principles and concepts of the present invention and generally designated by the reference numeral 10 will be described.

The present invention, the cake stacker system 10 is comprised of a plurality of components. Such components in their broadest context include a base plate, a lower cake support plate, an upper cake support plate, a center post, and a plurality of dowels. Such components are individually configured and correlated with respect to each other so as to attain the desired objective.

The cake stacker system 10 is for supporting and displaying a multi layer cake in a safe, secure, convenient and economical manner. First provided is a base plate 14 in a circular configuration with a center and a periphery and a first diameter. A threaded stud 16 extends upwardly from the center of the base plate.

Next provided is a lower cake support plate 20 in a circular configuration with a center and a periphery and a second diameter less than the first diameter. A central aperture 22 extends through the center of the lower cake support plate. A plurality of lower peripheral apertures 24 extend through the lower cake support plate adjacent to the periphery thereof. A plurality of primary nuts 26 are provided. The nuts are secured to the lower cake support plate. Each primary nuts extends downwardly from one of the lower peripheral apertures.

Next provided is an upper cake support plate 30 in a circular configuration with a center and a periphery and a third diameter less than the second diameter. A central aperture 32 extending through the center of the upper cake support plate. A plurality of upper peripheral apertures 34 extend through the upper cake support plate adjacent to the periphery thereof. A plurality of secondary nuts 36 are provided. The secondary nuts are secured to the upper cake support plate. Each secondary nut extends downwardly from one of the upper peripheral apertures.

A top cap plate 40 is next provided. The top cap plate is in a circular configuration with a center and a periphery and a fourth diameter less than the third diameter. A central nut 42 extends downwardly from the center of the top cap plate.

Next, a lower cake 46 is provided. The lower cake is on a lower cake board 48 and is positioned between the base plate and the lower cake support plate. The lower cake has a diameter between the first and second diameters.

Next, an intermediate cake 52 is provided. The intermediate cake is on an intermediate cake board 54 and is positioned between the lower and upper cake support plates. The intermediate cake has a diameter between the second and third diameters.

Next, an upper cake 58 is provided. The upper cake is on an upper cake board 60 and is positioned between the upper support plate and the top cap plate. The upper cake has a diameter between the third and fourth diameters.

A center post 64 is next provided. The center post is formed of a plurality of threaded rods 66 extending through the cakes and center apertures of the cake support plates. A plurality of threaded collars 67 are threadedly received on the threaded rods and the studs in contact with the base plate and the cake support plates and the top cap plate. A plurality of unthreaded collars on the threaded rods between the threaded collars are provided. The unthreaded collars 68 are of sizes to separate the cakes to heights corresponding to thicknesses of the cakes.

Next, a plurality of threaded lower dowels 70 extending through the lower peripheral apertures and nuts of the lower cake support plate are provided. The lower dowels extend downwardly to a location adjacent to the base plate and extend upwardly a distance between 25 and 75 percent of the thickness of the lower cake.

Lastly, in the primary embodiment, a plurality of threaded upper dowels 74 extending through the upper peripheral apertures and nuts of the upper cake support plate are provided. The upper dowels extend downwardly to a location adjacent to the lower cake support plate and extend upwardly a distance between 25 and 75 percent of the thickness of the upper cake.

An alternate embodiment of the invention is shown in FIGS. 4 and 5. In this embodiment, the support plates 104, 106 of the system 100 are in a symmetric tier above the base plate 108.

Another alternate embodiment of the invention is shown in FIG. 6. In this embodiment, the support plates 204, 206 of the system 200 are offset in opposite directions above the base plate 208.

Figure 7:
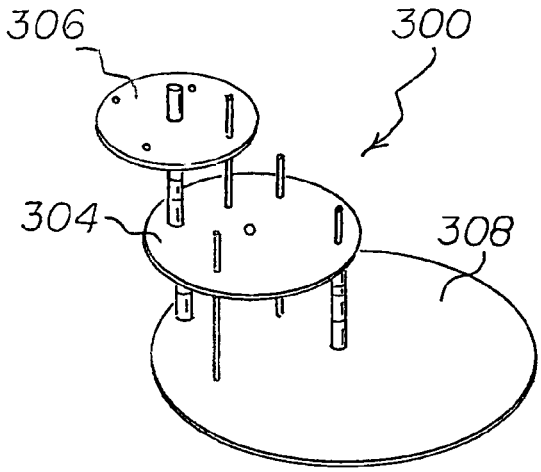

A further embodiment of the invention is shown in FIG. 7. In this embodiment, the support plates 304, 306 of the system 300 are cascading and offset in a common direction above the base plate 308.

Figure 8:
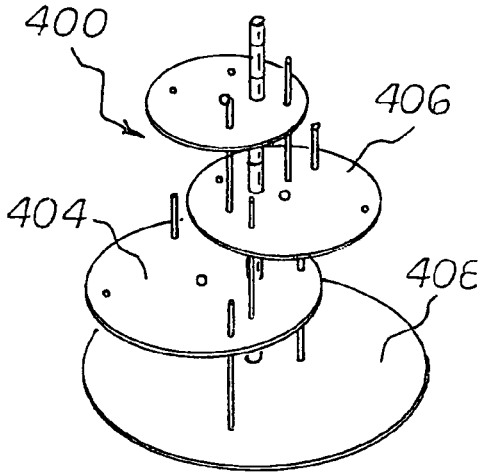

A still further embodiment of the invention is shown in FIG. 8. In this embodiment, the support plates 404, 406 of the system 400 are spiraling and offset in various directions above the base plate 408.

Figure 9:
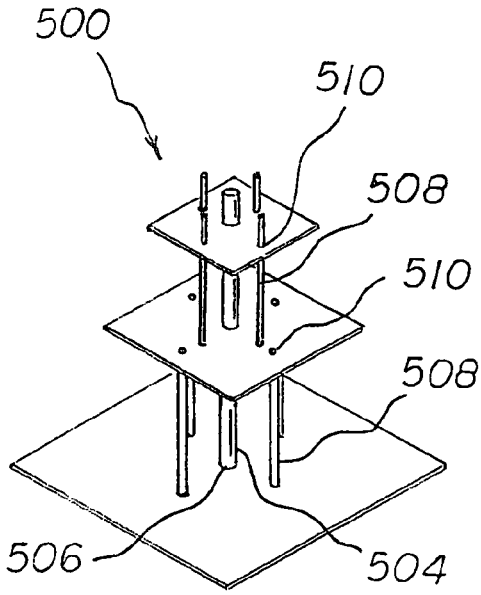

Another embodiment of the invention is shown in FIG. 9. In this embodiment the center post 504 of the system 500 has a lower end 506 screwed to the base plate. Also, the dowels 508 have upper ends 510 screwed to the support plates. The plates, center post, and dowels are fabricated of a disposable construction material chosen from the class of disposable construction materials including plastic, wood, cardboard and combinations thereof.

Figure 10:
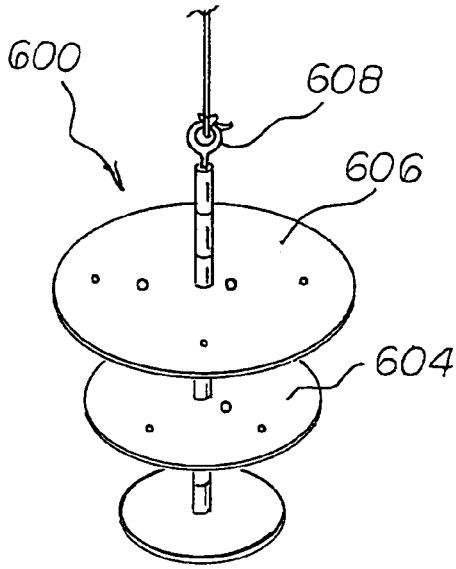

In a further embodiment, shown in FIG. 10, all of the plates 604, 606 of the system 600 are of increasing size from bottom to top in a chandelier configuration. A supporting hook extending upwardly from the center post.

There are three major problems in the cake decorating industry specifically as it involves wedding cakes. First is the delivery. The present invention allows safe delivery in its secure framework and avoids loss. Second is keeping the cake straight and level. Since the cakes rest on a level platform, the cakes will be straight and level which is not the case with the current industry process. Third is the ability to stack. Because of the antiquated way currently practiced in the industry, it takes years for a cake decorator to master the art of stacking cakes. The present invention allows even a novice to stack cakes in a timely and economic manner, bringing a higher quality and competitive nature to the cake decorating industry.

There are significant differences between the prior art the present invention. Specifically, the plates have threaded holes. The plates are connected together. External threaded dowels adjust through the plates. There are plates with holes. There are plates that are solid. Dowels exert pressure on the lower plate to create strength. The plates are available round and square. The plates will hold cakes sideways. The plates will hole cakes upside down. The plates form together to create a rigid platform to hold cakes even if they are turned sideways or upside down.

There are significant benefits attributable to the present invention. Specifically, the present invention protects cakes for a safe and convenient wedding cake delivery. The present invention makes cakes look level, even if they are not exactly level. Because the present invention is a versatile cake support system that can be assembled in many styles, cake decorators need only stock one stand, not several different sizes and styles wedding cake stands. The present invention is economical and will pay for itself by eliminating the need to spend excess money per cake on cake boards and dowels. The present invention uses pre-cut cake boards that will save time by eliminating the need to cut holes. The present invention has options, such as the spindle part that turns the stand into a cake turntable, or the pedestal option, and others to be even more useful. The present invention packs flat, like a pizza box, for easy, cost effective shipping. The present invention is reusable and dishwasher safe. The present invention allows the stacking of cakes faster at the shop and then delivery instead of stacking wedding cakes at the venue. The present invention is versatile allowing assembly in many designs of wedding cake stands.

Various different additional features and embodiments of the present invention are disclosed on the Internet at our website, www.cakestackers.com, the subject matter of which website is incorporated herein by reference.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A cake stacker system (10) for supporting and displaying a multi layer cake in a safe, secure, convenient and economical manner, the system comprising, in combination:

a base plate (14) in a circular configuration with a center and a periphery and a first diameter, the base plate having a threaded stud (16) extending upwardly from the center of the base plate;

a lower cake support plate (20) in a circular configuration with a center and a periphery and a second diameter less than the first diameter, the lower cake support plate having a central aperture (22) extending through the center thereof, the lower cake support plate having a plurality of lower peripheral apertures (24) extending through the lower cake support plate adjacent to the periphery thereof, a plurality of primary nuts (26)

secured to the lower cake support plate with each one of the primary nuts extending downwardly from one of the lower peripheral apertures;

an upper cake support plate (30) in a circular configuration with a center and a periphery and a third diameter less than the second diameter, the upper cake support plate having a central aperture (32) extending through the center thereof, the upper cake support plate having a plurality of upper peripheral apertures (34) extending through the upper cake support plate adjacent to the periphery thereof, a plurality of secondary nuts (36) secured to the upper cake support plate with each one of the secondary nuts extending downwardly from one of the upper peripheral apertures;

a top cap plate (40) in a circular configuration with a center and a periphery and a fourth diameter less than the third diameter, the top cap plate having a central nut (42) extending downwardly from the center of the top cap plate;

a lower cake (46) on a lower cake board (48) positioned between the base plate and the lower cake support plate, the lower cake having a diameter between the first and second diameters;

an intermediate cake (52) on an intermediate cake board (54) positioned between the lower and upper cake support plates, the intermediate cake having a diameter between the second and third diameters;

an upper cake (58) on an upper cake board (60) positioned between the upper support plate and the top cap plate, the upper cake having a diameter between the third and fourth diameters;

a center post (64) formed of a plurality of threaded rods (66) extending through the cakes and center apertures of the cake support plates, a plurality of threaded collars (67) threadedly received on the threaded rods and the stud in contact with the base plate and the cake support plates and the top cap plate, a plurality of unthreaded collars on the threaded rods between the threaded collars, the unthreaded collars (68) being of sizes to separate the cakes to heights corresponding to thicknesses of the cakes;

a plurality of threaded lower dowels (70) extending through the lower peripheral apertures and nuts of the lower cake support plate, the lower dowels extending downwardly to a location adjacent to the base plate and extending upwardly a distance between 25 and 75 percent of a thickness of the intermediate cake; and a plurality of threaded upper dowels (74) extending through the upper peripheral apertures and nuts of the upper cake support plate, the upper dowels extending downwardly to a location adjacent to the lower cake support plate and extending upwardly a distance between 25 and 75 percent of a thickness of the upper cake.

* * * * *